US005370422A

United States Patent [19]

Richardson

[11] Patent Number: 5,370,422

[45] Date of Patent: Dec. 6, 1994

[54] PLASTIC GREETING CARD WITH WRITING SURFACE

[76] Inventor: Jacqueline Richardson, 11054 Ventura Blvd. #207, Studio City, Calif. 91604

[21] Appl. No.: 83,981

[22] Filed: Jun. 28, 1993

[51] Int. Cl.[5] ..... B42D 15/00

[52] U.S. Cl. ..... 283/117; 40/124.1

[58] Field of Search ..... 283/61, 62, 117; 40/124.1; 446/147, 149, 150

[56] References Cited

U.S. PATENT DOCUMENTS

| | | | |
|---|---|---|---|
| 3,484,971 | 12/1969 | Liebman | 40/124.1 |
| 3,487,573 | 1/1970 | Slovacek | 40/124.1 |
| 3,669,829 | 6/1972 | Caldo et al. | 162/146 |
| 4,064,304 | 12/1977 | Fujita et al. | 428/207 |
| 4,348,449 | 9/1982 | Seufert | 428/167 |
| 4,890,402 | 1/1990 | Carroll | 40/124.1 |
| 5,257,823 | 11/1993 | Colvin, Jr. et al. | 40/124.1 |

*Primary Examiner*—Willmon Fridie

[57] ABSTRACT

A greeting card is provided comprising at least one sheet of transparent, flexible plastic material that has at least one linear fold extending across the sheet from one edge to the other edge. As such, a first portion of the sheet may be folded over onto a second portion of the sheet along the linear fold. The first portion of each sheet covers at least a part of the second portion of the sheet. The linear fold enables the first portion and the second portion of each sheet to normally remain in mutual close proximity, and further enables the unfolding of the portions to uncover the second portion of the sheet. A layer of opaque material that provides a writable surface is permanently adhered on a surface of at least one area of the sheet. Preferably, both the first portion and the second portion of each sheet include the at least one area containing the opaque material such that the areas of each portion are at least partly aligned when the sheet is folded. As such, with the portions folded into mutual proximity, at least part of the area of the opaque material on the second portion is covered by the area of the opaque material on the first portion so that writing on the opaque material on the second portion may be hidden until the sheet is unfolded.

10 Claims, 3 Drawing Sheets

PLASTIC GREETING CARD WITH WRITING SURFACE

The present application is a substitute application for a previous application on a similar device, Ser. No. 07/758,762, which is now expressely abandoned.

FIELD OF THE INVENTION

This invention relates generally to greeting cards, and, more particularly, to a transparent, plastic greeting card with a writing surface.

BACKGROUND OF THE INVENTION

Heretofore, greeting cards have commonly been supplied to the consumer in paper form or in a combination of materials consisting of primarily paper and plastic. Such greeting cards require use of paper so as to provide a writing surface. Unfortunately, wide-spread use of paper products depletes an important natural resource, namely trees. Further, paper greetings cards are commonplace, and therefore a greeting card manufactured from any other material would naturally be considered by a recipient as innovative, exciting, unique, and thoughtful.

When considering, therefore, a material other than paper that would be suitable for use as a greeting card, it is important for such a material to have a writing surface and to be easily folded. Plastic sheet material can be folded, for example by using a technique taught in U.S. Pat. No. 4,348,449 to Seufert on Sep. 7, 1982. However, plastic sheet materials do not absorb or retain ink and therefore cannot be used as a writing surface. While some manufacturers of such cards provide an additional paper sheet inside such a folded plastic sheet, such an additional paper sheet is a clumsy, unattractive solution. Further, it is difficult to inexpensively adhere such paper sheets to plastic sheets effectively.

Clearly, then, there is a need for a transparent, plastic greeting card that is easily folded using a variety of processes, yet also provides a writing surface that easily retains ink, lead, and the like. Such a needed card would allow multiple plastic pages to be used, and could be folded in such a way that the card would tend to stay open if opened or closed if closed. Such a needed card, further, could be manufactured from a readily recyclable material. Still further, such a needed greeting card would allow a variety of colorful and artistic artwork, messages, and other indicia to be printed or otherwise adhered thereon. The present invention fulfills these needs and provides further related advantages.

SUMMARY OF THE INVENTION

The present invention is a greeting card comprising at least one sheet of transparent, flexible plastic material that provides at least one linear fold element extending across the sheet from one edge to the other edge. As such, a first portion of the sheet may be folded over onto a second portion of the sheet along the linear fold element. The first portion of each sheet covers at least a part of the second portion of the sheet. The linear fold element enables the first portion and the second portion of each sheet to normally remain in mutual close proximity, and further enables the unfolding of the portions to uncover the first portion of the sheet. A layer of opaque material that provides a writable surface is permanently adhered on a surface of at least one area of the sheet. Preferably, both the first portion and the second portion of each sheet include the at least one area containing the opaque material such that the areas of each portion are at least partly aligned. As such, with the portions folded into mutual proximity, at least part of the area of the opaque material on the second portion is covered by the area of the opaque material on the first portion so that writing on the opaque material on the second portion may be hidden until the sheet is unfolded.

The present invention is a transparent, plastic greeting card that is easily folded using a variety of processes, yet also provides a writing surface that easily retains ink, lead, and the like. The present device allows multiple plastic pages to be used, and can be easily folded in such a way that the card tends to stay open if opened or closed if closed. The present card, further, can be manufactured from many readily recyclable materials, and as such allows a variety of colorful and artistic artwork, messages, and other indicia to be printed or otherwise adhered thereon. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 3A:
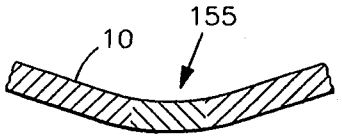
FIG. 3A is a cross sectional view of the invention, taken generally along lines 3—3 of FIG. 2, further illustrating a work-hardened linear folding element of the invention.
Figure 3B:
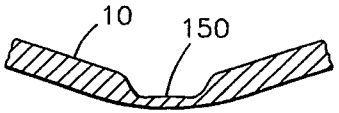
FIG. 3B is a cross sectional view of the invention, taken generally along lines 3—3 of FIG. 2, further illustrating a relatively thin linear folding element of the invention.
Figure 3C:
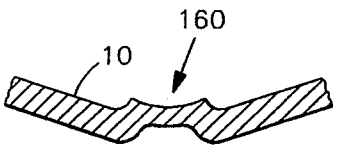
FIG. 3C is a cross sectional view of the invention, taken generally along lines 3—3 of FIG. 2, further illustrating an offset linear folding element of the invention.
Figure 3D:
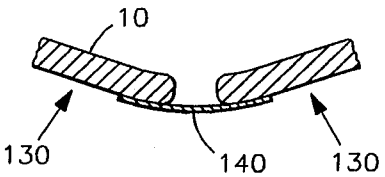
FIG. 3D is a cross sectional view of the invention, taken generally along lines 3—3 of FIG. 2, further illustrating an adhesive bound linear folding element for folding two separate sheet parts of the invention.
Figure 2:
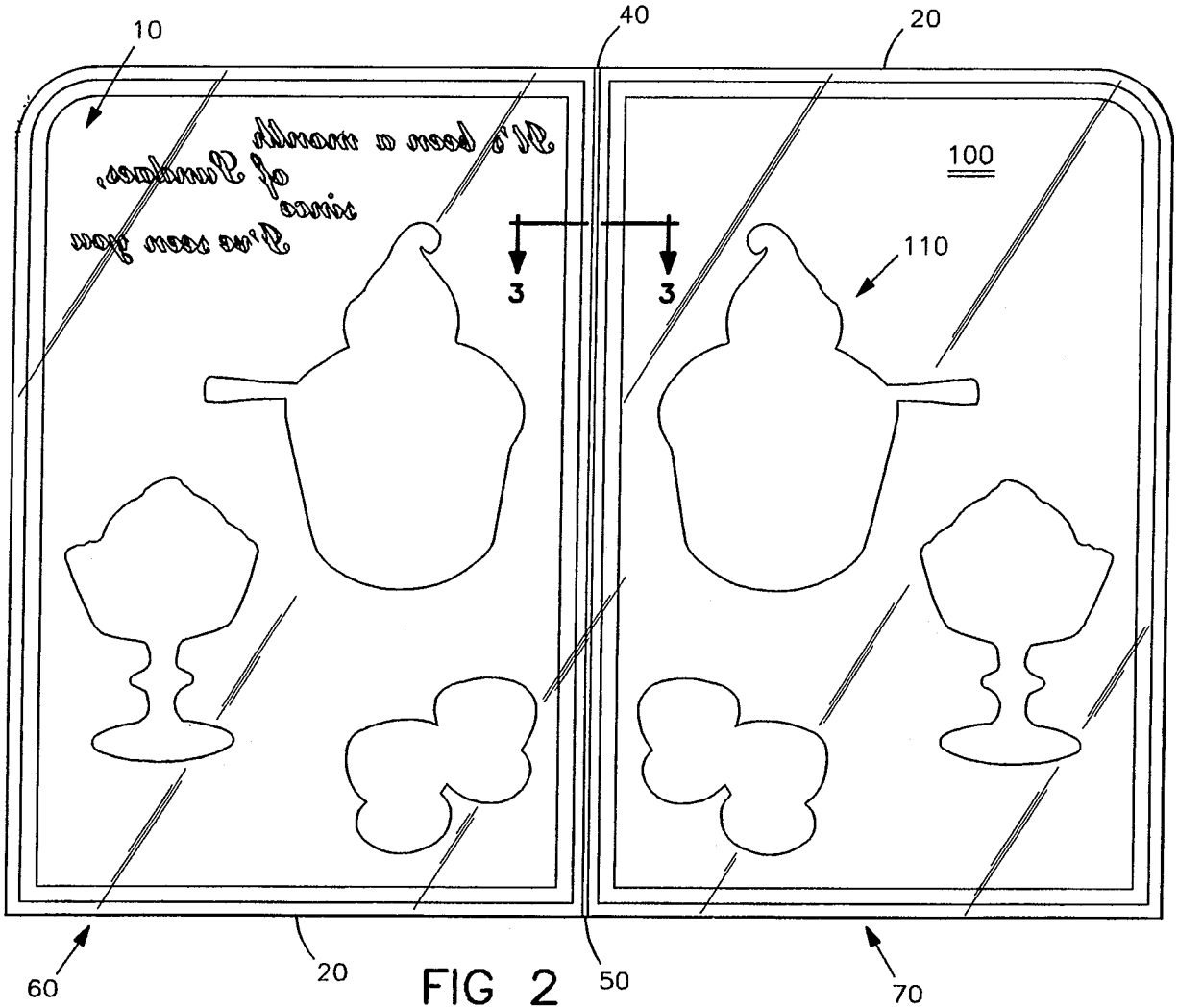
FIG. 2 is a rear elevational view of the invention, illustrating the sheet as unfolded.
Figure 4B:
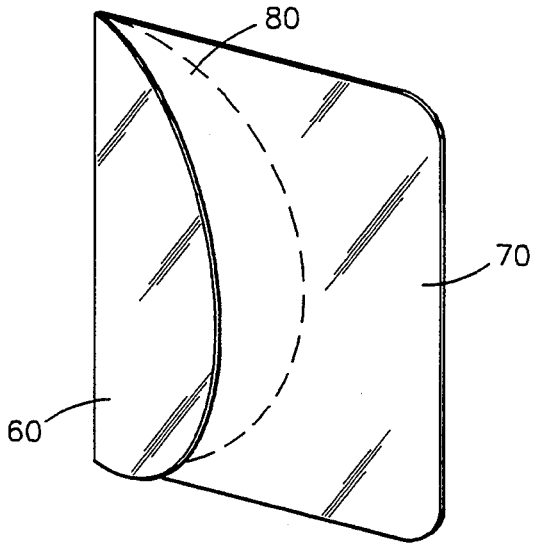
FIG. 4 is a front elevational view of the invention, illustrating the first portion of the sheet folded over onto the second portion of the sheet and covering a part of the second portion.

FIGS. I and 2 show a greeting card comprising at least one sheet 10 of transparent, flexible plastic material, each sheet 10 having a peripheral edge 20 extending therearound. Each sheet 10 provides at least one linear fold element 30 that extends from a first point 40 on the peripheral edge 20, across the sheet 10, to a second point 50 on the peripheral edge 20. As such, a first portion 60 of the sheet 10 may be folded over onto a second portion 70 of the sheet 10 along the linear fold element 30. In one embodiment of the invention, each linear fold element 30 comprises a linear portion 150 of the sheet 10 having a lesser thickness than the average thickness of the sheet 10 (FIG. 3B). Alternatively, each fold element 30 comprises a linear portion of the sheet 10 having a work hardened nature 150 (FIG. 3A). Alternatively, each linear fold element 30 comprises a linear portion of the sheet 10 having an offset 160 (FIG. 3C). As such, the fold element 30 has properties of resiliency, elasticity, and memory that are different in value than the average values of the same properties of the sheet 10. Alternatively, the card may comprise at least two separate parts 130 having edges in proximate relationship, with the linear fold element 30 being an adhesive binding means 140 for establishing a folding relationship between the two parts 130 (FIG. 3D).

The first portion 60 of each sheet 10 covers at least a part 80 of the second portion 70 of the sheet 10. The linear fold element 30 enables the first portion 60 and the second portion 70 of each sheet 10 to normally remain in mutual close proximity, and further enables the unfolding of the portions 60,70 to uncover the first portion 60 of the sheet 10.

Figure 1:
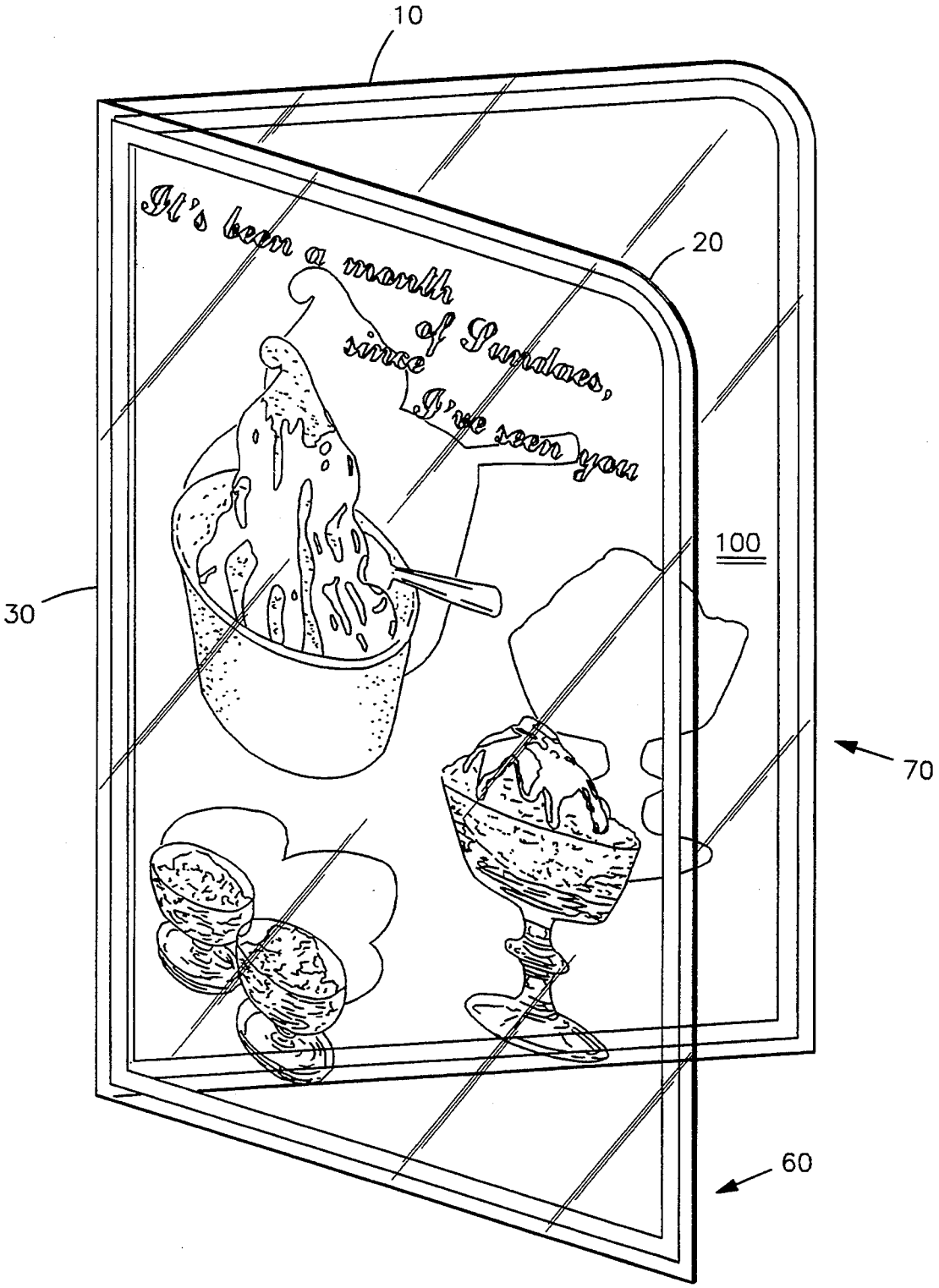
FIG. 1 is a perspective illustration of the invention, illustrating a transparent plastic sheet of the invention folded into a first portion and a second portion.

A layer 90 of opaque material 120 that provides a writable surface is permanently adhered on a surface 100 of at least one area 110 of the sheet 10. The layer 90 of opaque material 120 is preferably of a material that readily absorbs ink, paint, pencil lead markings, and the like. Such an opaque material 120 may be foil, plastic film, ink, dye, paint, chemical stain, an adhesive label, or the like. Such an opaque material 120 may be applied to the sheet 10 by silk screening, printing, lithographing, painting, adhering, or the like. Clearly, one side of the layer 90 preferably forms an artistic image, a message, or similar indicia, as illustrated in FIG. 1. Preferably, both the first portion 60 and the second portion 70 of each sheet 10 include the at least one area 110 containing the opaque material 120 such that the areas 110 of each portion 60,70 are at least partly aligned. As such, with the portions 60,70 folded into mutual proximity, at least part of the area 110 of the opaque material 120 on the second portion 70 is covered by the area 110 of the opaque material 120 on the first portion 60 so that writing on the opaque material on the second portion 70 may be hidden until the sheet 10 is unfolded.

Figure 5A:
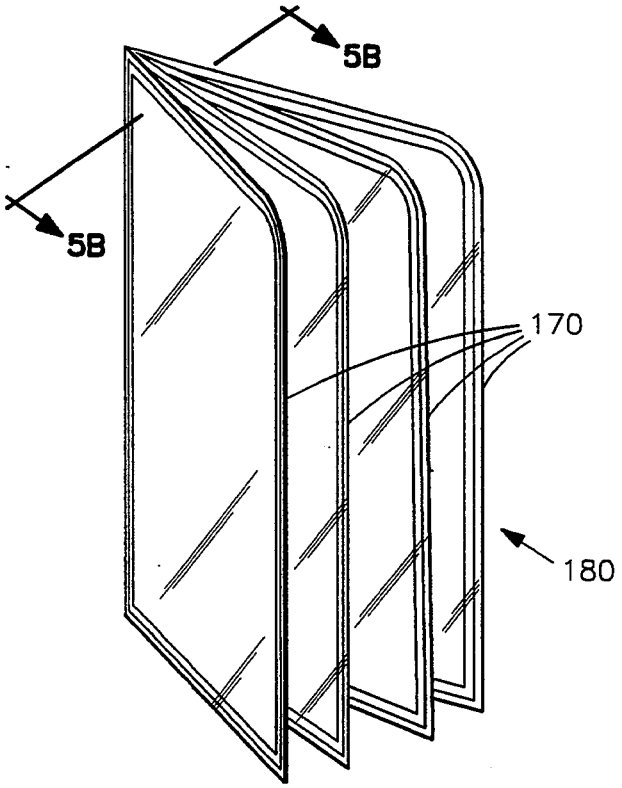
FIG. 5A is a perspective illustration of the invention, illustrating an embodiment of the invention that includes a plurality of sheets joined at the linear fold element of each sheet.
Figure 5B:
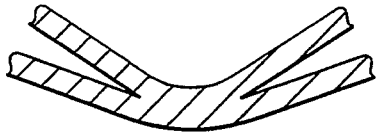
FIG. 5B is a cross sectional view of the invention, taken generally along lines 5B—5B of FIG. 5A, further illustrating the plurality of sheets joined at the linear fold element.

In one embodiment of the invention, illustrated in FIG. 5A, the card comprises a plurality of sheets 170 joined at the linear fold element 130 to form a book structure 180. Such a plurality of sheets 170 may be joined by thermal compression in at least one portion of the linear fold elements 30 (FIG. 5B).

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A greeting card comprising at least one sheet of transparent, flexible plastic material having a peripheral edge extending around the at least one sheet, the at lest one sheet providing at least one linear fold element, extending from a first point on the peripheral edge, across the at least one sheet, to a second point on the peripheral edge, enabling a first portion of the at least one sheet to be folded over onto a second portion of the at least one sheet along the at least one linear fold element, the first portion of the at least one sheet covering at least a part of the second portion of the at least one sheet, the at least one linear fold element enabling the first and the second portions of the at least one sheet to normally remain in mutual close proximity, and further enabling the unfolding of the portions to uncover the first portion of the sheet; and a layer of an opaque material permanently adhered on a surface of at least one area of the at least one sheet, the at least one opaque material providing a writable surface.

2. The greeting card of claim 1 wherein the at least one sheet comprises two separate parts having edges in proximate relationship, the at least one linear fold element being an adhesive binding means for establishing a folding relationship between the two parts.

3. The greeting card of claim 1 wherein the at least one linear fold element comprises a linear portion of the at least one sheet having a lesser thickness than the average thickness of the at least one sheet such that the at least one fold element has properties of resiliency, elasticity, and memory that are different in value than the average values of said properties of the at least one sheet.

4. The greeting card of claim 1 wherein the at least one linear fold element comprises a linear portion of the at least one sheet having a work hardened nature such that the fold element has properties of resiliency, elasticity, and memory that are different in value then the average values of said properties of the at least one sheet.

5. The greeting card of claim 1 wherein the at least one linear fold element comprises a linear portion of the at least one sheet having an offset such that the at least one fold element has properties of resiliency, elasticity, and memory that are different in value then the average values of said properties of the at least one sheet.

6. The greeting card of claim 1 wherein the at least one sheet is a plurality of sheets joined at the at least one linear fold element to form a book structure.

7. The greeting card of claim 6 wherein the plurality of sheets are joined by thermal compression in at least one portion of the at least one linear fold element.

8. The greeting card of claim 1 wherein the first and second portions of the at least one sheet each include at least one of the at least one area of the sheet containing the opaque material, the portions of the opaque material of the first sheet being at least partly aligned with the portions of the opaque material of the second sheet such that with the first and the second portions of the sheet folded into mutual proximity, at least part of the areas of the opaque material on the second portion are covered by the areas of the opaque material on the first portion so that writing on the opaque material on the second portion may be hidden until the greeting card is opened.

9. The greeting card of claim 1 wherein the opaque material is a material taken from the group of materials including foils, plastics films, inks, dyes, paints, and stains.

10. The greeting card of claim 1 wherein the opaque material is applied to the sheet by a technique taken from the group of techniques including silk screening, printing, lithographing, painting, and adhering.

* * * * *